US008179356B2

(12) United States Patent
Cheng

(10) Patent No.: US 8,179,356 B2
(45) Date of Patent: May 15, 2012

(54) METHOD FOR DRIVING LIQUID CRYSTAL DISPLAY WITH INSERTING GRAY IMAGE

(75) Inventor: Yung-Chiang Cheng, Miao-Li (TW)

(73) Assignee: Chimei Innolux Corporation, Chu-Nan, Miao-Li County (TW)

( * ) Notice: Subject to any disclaimer, the term of this patent is extended or adjusted under 35 U.S.C. 154(b) by 839 days.

(21) Appl. No.: 12/082,783

(22) Filed: Apr. 14, 2008

(65) Prior Publication Data

US 2008/0252586 A1 Oct. 16, 2008

(30) Foreign Application Priority Data

Apr. 13, 2007 (CN) ..... 2007 1 0074025

(51) Int. Cl.
*G09G 3/36* (2006.01)

(52) U.S. Cl. ..... 345/99

(58) Field of Classification Search ..... 345/87–104
See application file for complete search history.

(56) References Cited

U.S. PATENT DOCUMENTS 6,473,077 B1 * 10/2002 Takenaka et al. ..... 345/209
6,683,595 B2 * 1/2004 Ikeda ..... 345/95
6,693,618 B2 2/2004 Son et al.
2003/0218587 A1 * 11/2003 Ikeda ..... 345/87
2005/0200619 A1 * 9/2005 Adachi et al. ..... 345/204
2006/0082530 A1 4/2006 Chen et al.
2006/0164380 A1 * 7/2006 Yang et al. ..... 345/103
2006/0232217 A1 * 10/2006 Oh et al. ..... 315/169.3
2007/0052861 A1 * 3/2007 Osawa et al. ..... 348/649
2009/0278869 A1 * 11/2009 Oishi et al. ..... 345/691

FOREIGN PATENT DOCUMENTS

CN 1191559 C 3/2005
JP 2006-343706 A * 12/2006
TW I226949 B 1/2005

* cited by examiner

*Primary Examiner* — Jimmy H Nguyen

(74) *Attorney, Agent, or Firm* — Muncy, Geissler, Olds & Lowe, PLLC

(57) ABSTRACT

An exemplary method for driving a liquid crystal display includes: dividing a frame into a first sub-frame period and a second sub-frame period; displaying a normal image in the first sub-frame period; and displaying a gray image in the second sub-frame period. The gray image includes a plurality of pixels, and some of the pixels are black, and each of the pixels is black at least one time in a predefined minimum period, the minimum period being at least two consecutive frames.

6 Claims, 5 Drawing Sheets

METHOD FOR DRIVING LIQUID CRYSTAL DISPLAY WITH INSERTING GRAY IMAGE

FIELD OF THE INVENTION

The present invention relates to methods for driving liquid crystal displays (LCDs), and more particularly to a method for driving an LCD with insertion of gray images.

GENERAL BACKGROUND

LCDs are widely used in various modern information products, such as notebooks, personal digital assistants, video cameras and the like.

When motion pictures are displayed on an LCD, a so-called residual image phenomenon may occur. A motion picture is a series of images displayed one after another in rapid succession. In general, the displaying of each image lasts for a period of time known as a frame. Typically, each frame lasts a small fraction of a second. When a viewer is viewing an image of a current frame, the viewer may still be perceiving the image of the previous frame. That is the image of the previous frame remains in the viewer's perception as a so-called afterimage. The afterimage overlaps with the image of the current frame being viewed, and this causes the residual image phenomenon. From the standpoint of the viewer, the display quality of the LCD is impaired. To overcome the above-described problem, a method known as black insertion driving has been developed to drive an LCD.

FIG. 7 is an abbreviated circuit diagram of a conventional LCD. The LCD 100 includes a liquid crystal panel 101, a scanning circuit 102, and a data circuit 103. The scanning circuit 102 and the data circuit 103 are configured for driving the liquid crystal panel 101.

The liquid crystal panel 101 includes a plurality of parallel scanning lines 110, a plurality of parallel data lines 120 orthogonal to the plurality of parallel scanning lines 110, and a plurality of pixel regions 130 cooperatively defined by the crossing scanning lines 110 and data lines 120. The scanning lines 110 are electrically coupled to the scanning circuit 102. The data lines 120 are electrically coupled to the data circuit 103.

Each pixel region 130 includes a thin film transistor (TFT) 131, a pixel electrode 132, a common electrode 134, and liquid crystal molecules (not shown) interposed between the pixel electrode 132 and the common electrode 134. The TFT 131 is disposed near an intersection of a corresponding one of the scanning lines 110 and a corresponding one of the data lines 120. A gate electrode of the TFT 131 is electrically coupled to the corresponding scanning line 110, and a source electrode of the TFT 131 is electrically coupled to the corresponding data line 120. Further, a drain electrode of the TFT 131 is electrically coupled to the pixel electrode 132. The common electrode 203 is electrically coupled to a common voltage generating circuit (not shown) that is configured to provide common voltages. Moreover, each pixel electrode 132, the corresponding common electrode 134, and the liquid crystal molecules therebetween cooperatively form a liquid crystal capacitor 133.

Referring to FIG. 8 and FIG. 9, when the LCD 100 is driven by the black insertion driving method, each frame period is divided into a first sub-frame period T1 and a second sub-frame period T2. In particular, the first sub-frame period T1 serves as a normal display period, and the second sub-frame period T2 serves as a black frame insertion period.

During the first sub-frame period T1, a plurality of first scanning signals 150 are generated by the scanning circuit 102, and are sequentially supplied to the scanning lines 110, so as to scan the corresponding pixel regions 130 row by row. When the corresponding row of pixel regions 130 are scanned by the first scanning signal 150, the TFTs 131 of the pixel regions 130 are switched on. The data circuit 103 then supplies a plurality of first driving voltages to the pixel electrodes 132 of the pixel regions 130 via the data lines 120 and the TFTs 131. Thus, during the first sub-frame period T1, the LCD 100 displays a normal image 201.

During the second sub-frame period T2, the scanning circuit 102 supplies a plurality of second scanning signals 160 to switch on the TFTs 131 of pixel regions 130 row by row. The data circuit 103 supplies a plurality of second driving voltages having values the same as that of the corresponding common voltages supplied to the pixel electrodes 132 of the pixel regions 130. Thus, during the second sub-frame period T2, the LCD 100 displays a black image 202. The black image 202 includes a plurality of pixels (not labeled) arranged in a matrix, and all the pixels are black. Each of the pixels corresponds to one of the pixel regions 130 of the LCD 100.

By employing the black insertion driving method, normal images 201 and black images 202 are displayed alternately. In a complete frame period, a viewer perceives the normal image 201 during the first sub-frame period T1, and perceives the black image 202 during the second sub-frame period T2. Thus, an afterimage of the normal image 201 displayed in the first sub-frame period T1 is removed from the viewer's perception during the second sub-frame period T2. This means that the problem of the residual image phenomenon can be solved.

However, the black image 202 has the least brightness among all images displayed by the LCD 100. For example, in a continuous four frame periods, the LCD displays four normal images 201 and four black images 202. A time of displaying the four black images 202 is equal to that of displaying the four normal images 201. Thus, a brightness of images displayed by the LCD 100 is seriously reduced.

It is, therefore, desired to provide a method for driving an LCD which can overcome the above-described deficiencies.

SUMMARY

In one aspect, a method for driving a liquid crystal display includes: dividing a frame into a first sub-frame period and a second sub-frame period; displaying a normal image in the first sub-frame period; and displaying a gray image in the second sub-frame period. The gray image includes a plurality of pixels, and some of the pixels are black, and each of the pixels is black at least one time in a predefined minimum period, the minimum period being at least two consecutive frames.

In another aspect, a method for driving a liquid crystal display includes: providing a driving circuit; the driving circuit generating a plurality of first signals corresponding to displaying a normal image; and the driving circuit generating a plurality of second signals corresponding to displaying a gray image between each two sequential normal images. Any four sequential gray images dither into M black image(s) as perceived by the human eye, M being a positive integer less than four.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
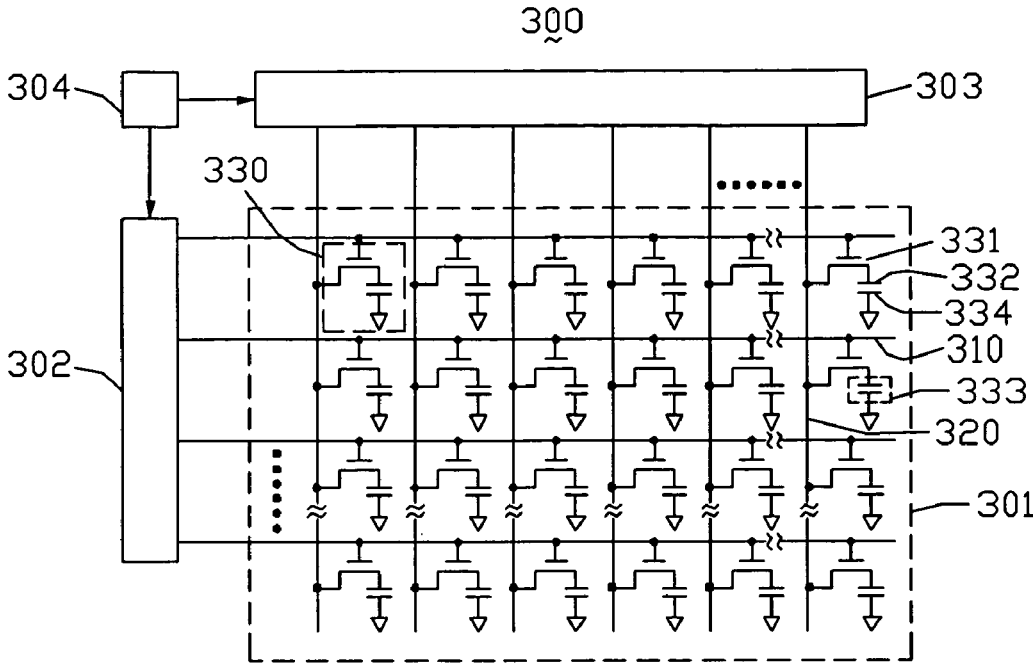
FIG. 1 is an abbreviated circuit diagram of an LCD that employs a driving method according to an exemplary embodiment of the present invention, the LCD including a plurality of scanning lines.

FIG. 1 is an abbreviated circuit diagram of an LCD that employs a driving method according to an exemplary embodiment of the present invention. The LCD 300 includes a liquid crystal panel 301 and a driving circuit (not labeled). The driving circuit includes a scanning circuit 302, a data circuit 303, and a timing control circuit 304. The scanning circuit 302 is configured for providing a plurality of scan signals. The data circuit 303 is configured for providing a plurality of data voltages. The timing control circuit 304 is configured for controlling driving timing of the scanning circuit 302 and the data circuit 303.

The liquid crystal panel 301 includes a plurality of parallel scanning lines 310, a plurality of parallel data lines 320 orthogonal to the plurality of parallel scanning lines 310, and a plurality of pixel regions 330 cooperatively defined by the crossing scanning lines 310 and data lines 320. The scanning lines 310 are electrically coupled to the scanning circuit 302. The data lines 320 are electrically coupled to the data circuit 303. Moreover, the plurality of pixel regions 330 are arrayed in a matrix, such as that the LCD 300 is an active matrix LCD.

Each pixel region 330 includes a TFT 331, a pixel electrode 332, a common electrode 334, and liquid crystal molecules (not shown) interposed between the pixel electrode 332 and the common electrode 334. The TFT 331 is disposed near an intersection of a corresponding one of the scanning lines 310 and a corresponding one of the data lines 320. A gate electrode of the TFT 331 is electrically coupled to the corresponding scanning line 310, and a source electrode of the TFT 331 is electrically coupled to the corresponding data line 320. Further, a drain electrode of the TFT 331 is electrically coupled to the pixel electrode 332. The common electrode 334 is electrically coupled to a common voltage generating circuit (not shown). The common voltage generating circuit is configured to provide common voltages. When a value of the common voltage is equal to a minimum value of the data voltages, the pixel region 330 displays black. Moreover, each pixel electrode 332, the corresponding common electrode 334, and the liquid crystal molecules therebetween cooperatively form a liquid crystal capacitor 333.

Figure 2:
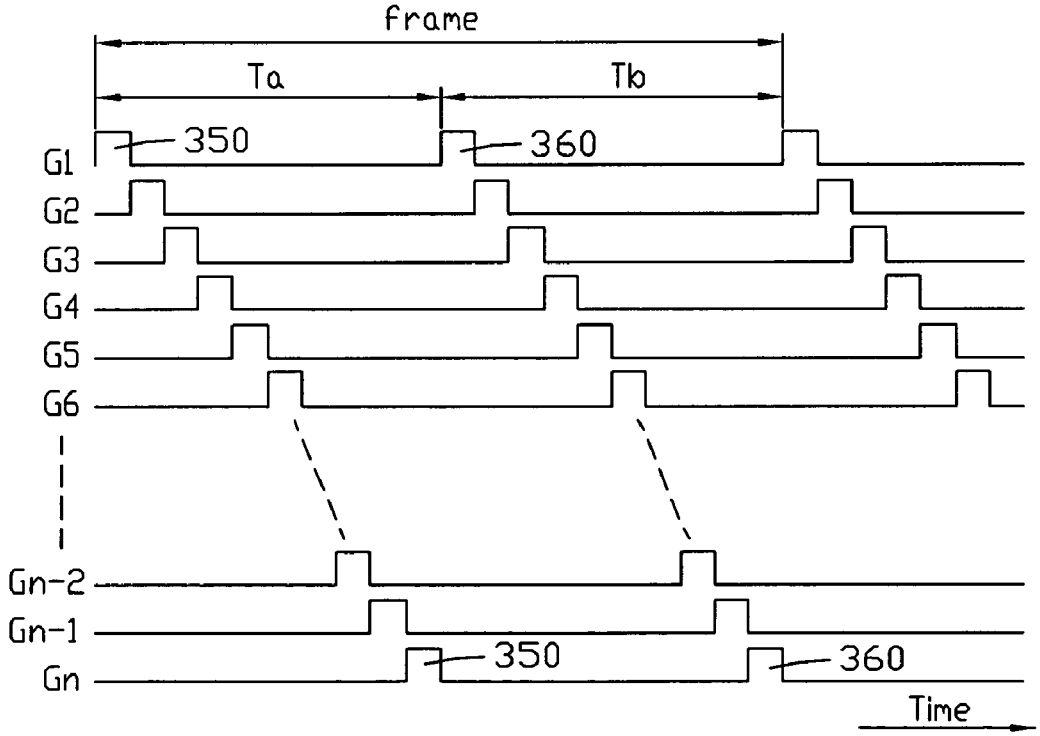
FIG. 2 is a waveform diagram of scan signals of the scanning lines of FIG. 1.
Figure 3:
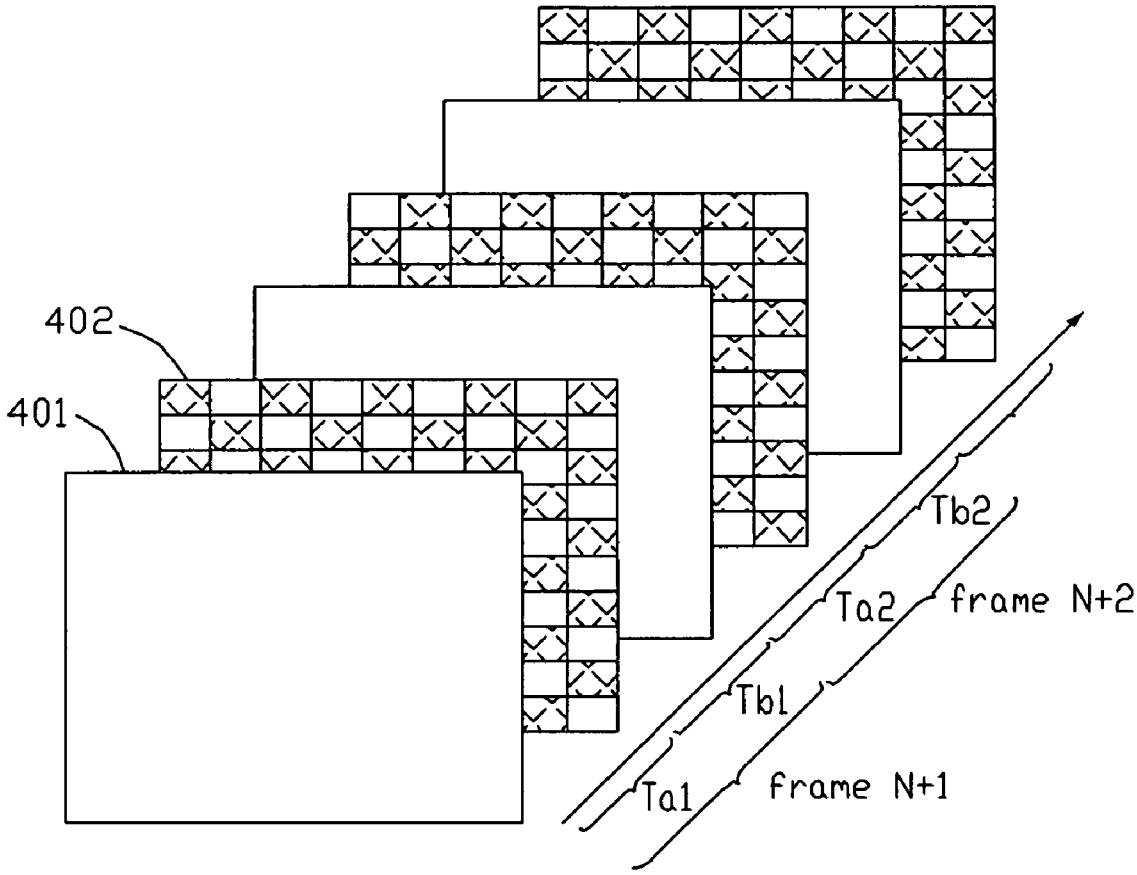
FIG. 3 is a diagram illustrating an operation principle of displaying normal images and gray images on the LCD of FIG. 1.

Referring to FIG. 2 and FIG. 3, each frame period is divided into a first sub-frame period Ta and a second sub-frame period Tb. In this embodiment, Ta=Tb. In other embodiments, Ta may be greater than Tb, or Tb may be greater than Ta.

During the first sub-frame period Ta, a plurality of first scanning signals 350 are generated by the scanning circuit 302, and are sequentially supplied to the scanning lines 310, so as to scan the corresponding pixel regions 330 row by row. When the corresponding row of pixel regions 330 are scanned by the first scanning signal 350, the TFTs 331 of the pixel regions 330 are switched on. The data circuit 303 then supplies a plurality of first data voltages to the pixel electrodes 332 of the pixel regions 330 via the data lines 320 and the TFTs 331. The first data voltages correspond to a normal image 401. Thus, during the first sub-frame period Ta, the LCD 300 displays the normal image 401.

During the second sub-frame period Tb, the scanning circuit 302 supplies a plurality of second scanning signals 360 to switch on the TFTs 331 of pixel regions 330 row by row. The data circuit 303 supplies a plurality of second data voltages to the pixel electrodes 332 of the pixel regions 330. Some of the data voltages have the minimum value, and other data voltages have the same values as those of the first sub-frame period Ta. Thus, during the second sub-frame period Tb, the LCD 300 displays a gray image 402.

Figure 4:
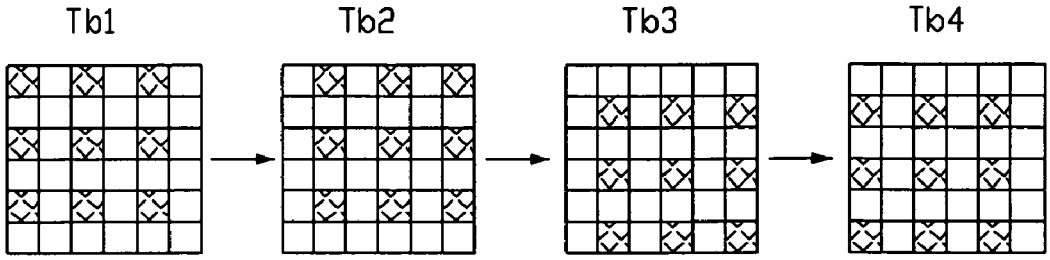
FIG. 4 is a diagram of a first example pattern of a gray image for display according to FIG. 3.
Figure 5:
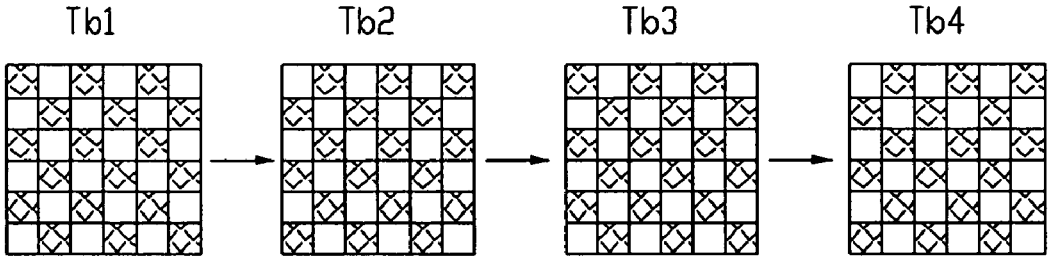
FIG. 5 is a diagram of a second example pattern of a gray image for display according to FIG. 3.
Figure 6:
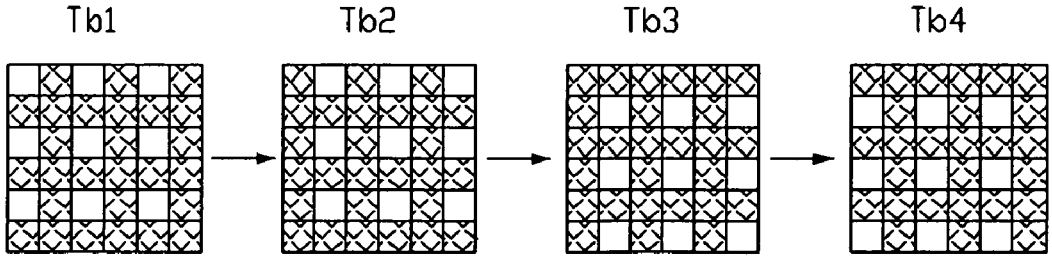
FIG. 6 is a diagram of a third example pattern of a gray image for display according to FIG. 3.
Figure 7:
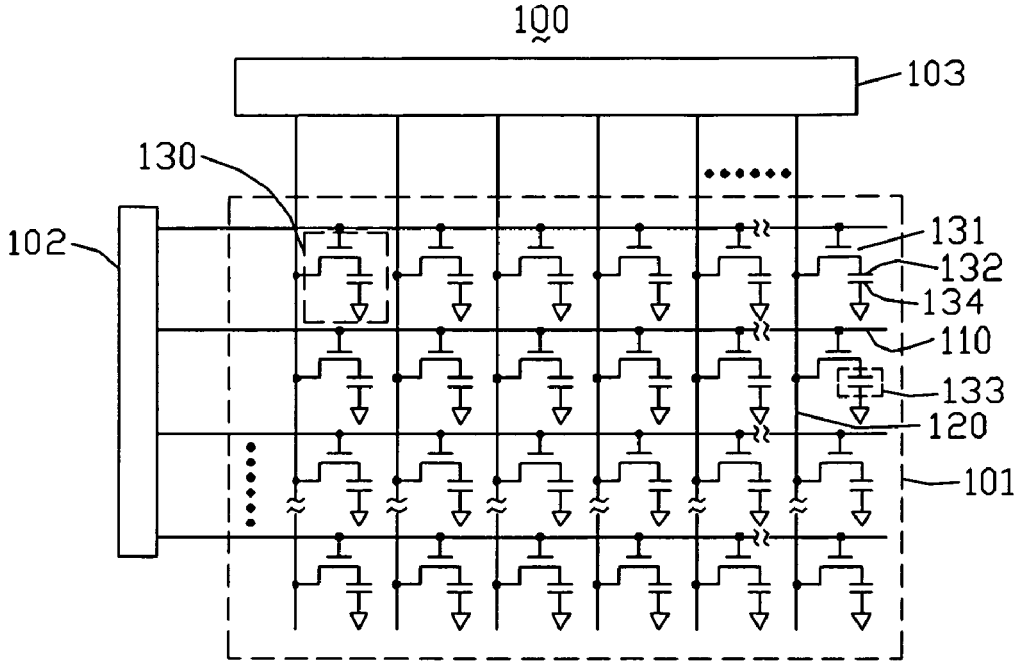
FIG. 7 (RELATED ART)
FIG. 7 is an abbreviated circuit diagram of a conventional LCD, the LCD including a plurality of scanning lines.
Figure 8:
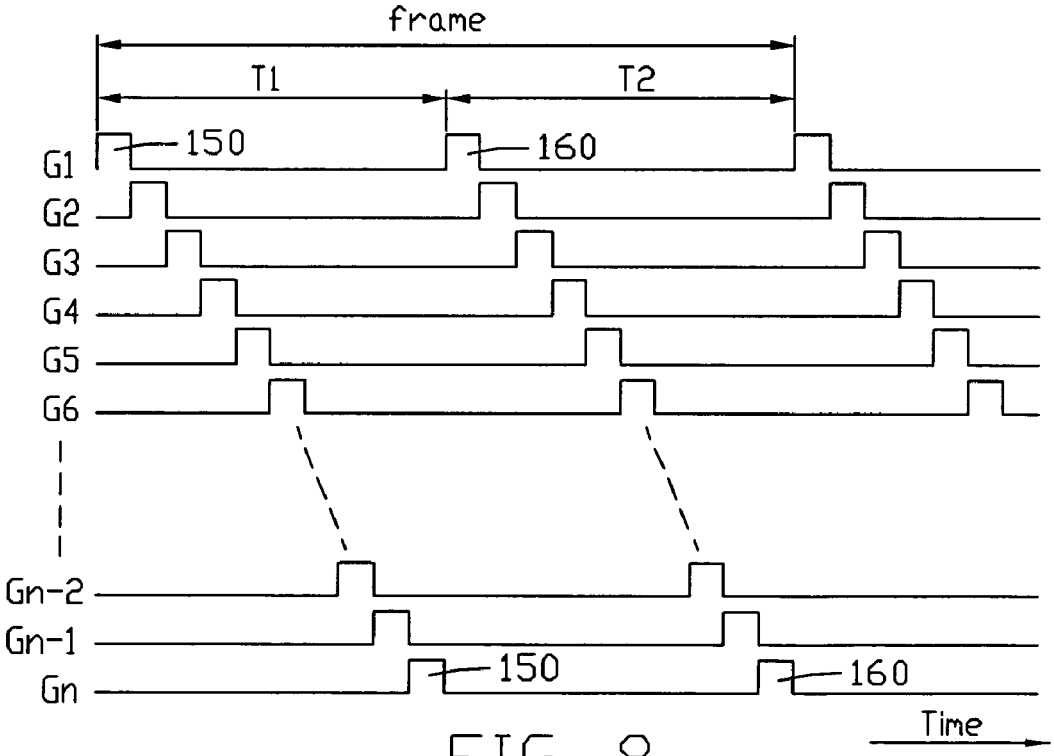
FIG. 8 (RELATED ART)
FIG. 8 is a waveform diagram of scan signals of the scanning lines of FIG. 7.
Figure 9:
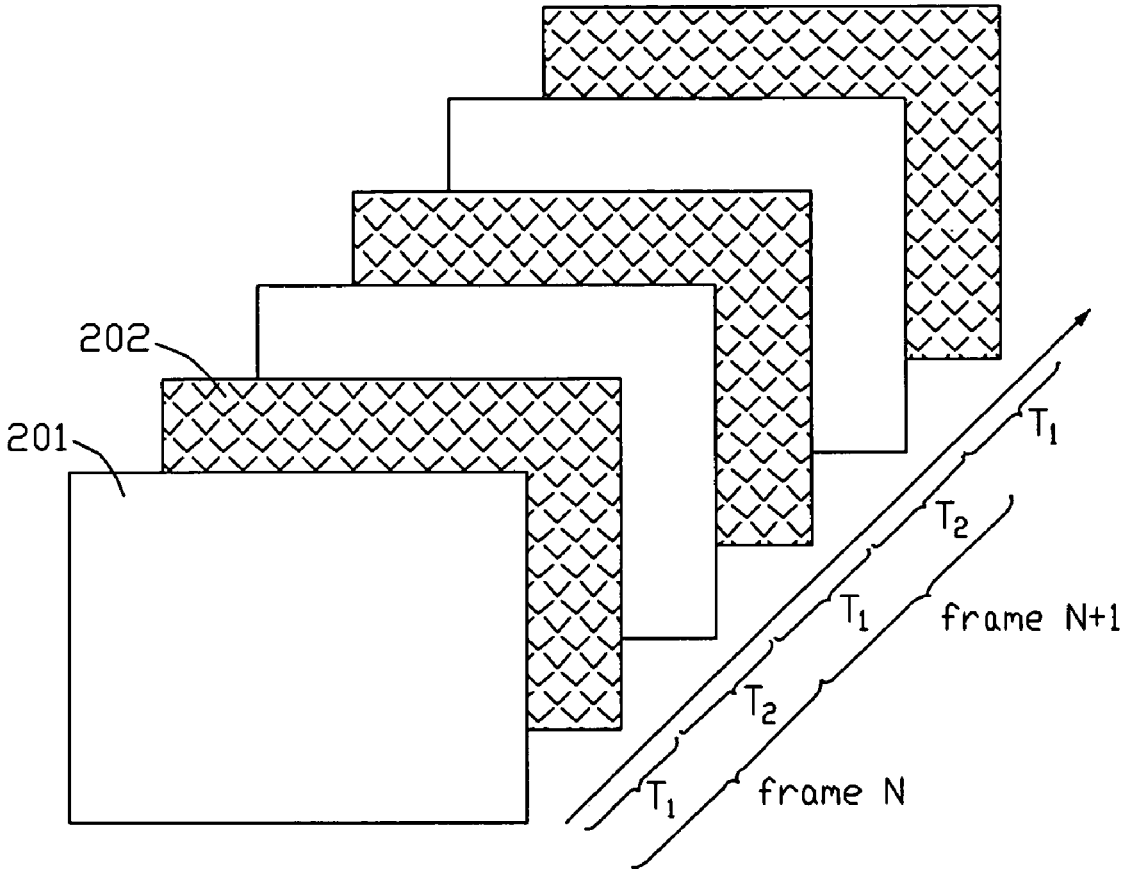
FIG. 9 (RELATED ART)
FIG. 9 is a diagram illustrating an operation principle of displaying normal images and black images on the LCD of FIG. 7.

The gray image 402 includes a plurality of pixels (not labeled) arranged in a matrix, and each of the pixels corresponds to one of the pixel regions 330 of the LCD 300. The gray image 402 can have any one of many different possible patterns. Three example patterns are shown in FIG. 4, FIG. 5, and FIG. 6, respectively. The example pattern of FIG. 5 is the same as that of the gray image 402 as illustrated in FIG. 3.

FIG. 4 is a diagram of a first example pattern for the gray image 402. In a second sub-frame period Tb1 of the frame N+1 (N is a natural number), pixels at crossings of all the odd rows and all the odd columns are black, and other pixels keep the same colors as those in a first sub-frame Ta1 of the frame N+1. In a second sub-frame period Tb2 of the frame N+2, pixels at crossings of all the odd rows and all the even columns are black, and other pixels keep the same colors as those in a first sub-frame Ta2 of the frame N+2. In a second sub-frame period Tb3 of the frame N+3, pixels at crossings of all the even rows and all the even columns are black, and other pixels keep the same colors as those in a first sub-frame Ta3 of the frame N+3. In a second sub-frame period Tb4 of the frame N+4, pixels at crossings of all the even rows and all the odd columns are black, and other pixels keep the same colors as those in a first sub-frame Ta4 of the frame N+4. Frame N+1, frame N+2, frame N+3, and frame N+4 together define a minimum period. The gray images 402 in the following second sub-frame periods repeat the above-described patterns of the frame N+1, frame N+2, frame N+3, and frame N+4. The gray images 402 in any four continuous frames dither into a black image as perceived by a human observer. A brightness of any gray image 402 is higher than that of the conventional black image 202 of the above-described conventional black insertion driving method.

FIG. 5 is a diagram of a second pattern of the gray image of FIG. 3. In a second sub-frame period Tb1 of the frame N+1, pixels at crossings of all the odd rows and all the odd columns are black, pixels at crossings of all the even rows and all the even columns are black, and other pixels keep the same color as that in a first sub-frame Ta1 of the frame N+1. In a second sub-frame period Tb2 of the frame N+2, pixels at crossings of all the odd rows and all the even columns are black, pixels at crossings of all the even rows and all the odd columns are black, and other pixels keep the same color as that in a first sub-frame Ta2 of the frame N+2. In a second sub-frame period Tb3 of the frame N+3, pixels at crossings of all the odd rows and all the odd columns are black, pixels at crossings of all the even rows and all the even columns are black, and other pixels keep the same color as that in a first sub-frame Ta3 of the frame N+3. In a second sub-frame period Tb4 of the frame N+4, pixels at crossings of all the odd rows and all the even columns are black, pixels at crossings of all the even rows and all the odd columns are black, and other pixels keep the same color as that in a first sub-frame Ta4 of the frame N+4. Frame N+1, frame N+2, frame N+3, and frame N+4 define a minimum period. The gray image 402 in the following second sub-frame periods repeat that in one of the frame N+1, frame N+2, frame N+3, and frame N+4. The gray images 402 in any four continuous frames dither into two black images by human eyes. That is, a brightness of any gray image 402 in FIG. 4 is higher than that of the black image 202 of the above-described conventional black insertion driving method.

FIG. 6 is a diagram of a third pattern of the gray image of FIG. 3. In a second sub-frame period Tb1 of the frame N+1, pixels at crossings of all the odd rows and all the odd columns keep the same color as that in a first sub-frame Ta1 of the frame N+1, and other pixels are black. In a second sub-frame period Tb2 of the frame N+2, pixels at crossings of all the odd rows and all the even columns keep the same color as that in a first sub-frame Ta2 of the frame N+2, and other pixels are black. In a second sub-frame period Tb3 of the frame N+3, pixels at crossings of all the even rows and all the even columns keep the same color as that in a first sub-frame Ta3 of the frame N+3, and other pixels are black. In a second sub-frame period Tb4 of the frame N+4, pixels at crossings of all the even rows and all the odd columns keep the same color as that in a first sub-frame Ta4 of the frame N+4, and other pixels are black. Frame N+1, frame N+2, frame N+3, and frame N+4 define a minimum period. The gray images 402 in the following second sub-frame periods repeat that in one of the frame N+1, frame N+2, frame N+3, and frame N+4. The gray images 402 in any four continuous frames dither into three black images by human eyes. That is, a brightness of any gray image 402 in FIG. 4 is higher than that of the black image 202 of the above-described conventional black insertion driving method.

In the three above-described example patterns for the gray image 402, the gray images 402 in any four continuous frames dither into one, two, or three black image(s) by human eyes, respectively. Thus, the driving method of the above-described embodiments can solve the residual image phenomenon. Furthermore, the brightness of any gray image 402 is higher than that of the black image 202 of the above-described conventional black insertion driving method. Thus, the brightness of the LCD 300 is higher than that of the LCD 100 employing the above-described conventional black insertion driving method.

It is to be further understood that even though numerous characteristics and advantages of preferred and exemplary embodiments have been set out in the foregoing description, together with details of the structures and functions of the embodiments, the disclosure is illustrative only; and that changes may be made in detail within the principles of the present invention to the full extent indicated by the broad general meaning of the terms in which the appended claims are expressed.

What is claimed is:

1. A method for driving a liquid crystal display, comprising:

dividing a frame into a first sub-frame period and a second sub-frame period, the first sub-frame period being equal to the second sub-frame period;

displaying a normal image in the first sub-frame period; and displaying a gray image in the second sub-frame period;

wherein the gray image comprises a plurality of pixels, some of the pixels are black and other pixels are not black, each of the pixels is black only one time in a predefined minimum period, and the minimum period is four frames, the four frames are frame N+1, frame N+2, frame N+3, and frame N+4, N is a natural number.

2. The method for driving the liquid crystal display as claimed in claim 1, wherein in a second sub-frame period of the frame N+1, pixels at crossings of all the odd rows and all the odd columns are black, and other pixels keep the same color as that in the first sub-frame of the frame N+1; in a second sub-frame period of the frame N+2, pixels at crossings of all the odd rows and all the even columns are black, and other pixels keep the same color as that in the first sub-frame of the frame N+2; in a second sub-frame period of the frame N+3, pixels at crossings of all the even rows and all the even columns are black, and other pixels keep the same color as that in the first sub-frame of the frame N+3; in a second sub-frame period of the frame N+4, pixels at crossings of all the even rows and all the odd columns are black, and other pixels keep the same color as that in the first sub-frame of the frame N+4.

3. A method for driving a liquid crystal display, comprising:

dividing a frame into a first sub-frame period and a second sub-frame period, the first sub-frame period being equal to the second sub-frame period;

displaying a normal image in the first sub-frame period; and displaying a gray image in the second sub-frame period;

wherein the gray image comprises a plurality of pixels, some of the pixels are black and other pixels are not black, each of the pixels is black two times in a predefined minimum period, the minimum period is four frames, and the four frames are frame N+1, frame N+2, frame N+3, and frame N+4, N is a natural number;

wherein in a second sub-frame period of the frame N+1, pixels at crossings of all the odd rows and all the odd columns are black, pixels at crossings of all the even rows and all the even columns are black, and other pixels keep the same color as that in the first sub-frame of the frame N+1; in a second sub-frame period of the frame N+2, pixels at crossings of all the odd rows and all the even columns are black, pixels at crossings of all the even rows and all the odd columns are black, and other pixels keep the same color as that in the first sub-frame of the frame N+2; in a second sub-frame period of the frame N+3, pixels at crossings of all the odd rows and all the odd columns are black, pixels at crossings of all the even rows and all the even columns are black, and other pixels keep the same color as that in the first sub-frame of the frame N+3; in a second sub-frame period of the frame N+4, pixels at crossings of all the odd rows and all the even columns are black, pixels at crossings of all the even rows and all the odd columns are black, and other pixels keep the same color as that in the first sub-frame of the frame N+4.

4. A method for driving a liquid crystal display, comprising:

dividing a frame into a first sub-frame period and a second sub-frame period, the first sub-frame period being equal to the second sub-frame period;

displaying a normal image in the first sub-frame period; and displaying a gray image in the second sub-frame period;

wherein the gray image comprises a plurality of pixels, some of the pixels are black and other pixels are not black, each of the pixels is black three times in a predefined minimum period, the minimum period is four frames, and the four frames are frame N+1, frame N+2, frame N+3, and frame N+4, N is a natural number;

wherein in a second sub-frame period of the frame N+1, pixels at crossings of all the odd rows and all the odd columns keep the same color as that in the first sub-frame of the frame N+1, and other pixels are black; in a second sub-frame period of the frame N+2, pixels at crossings of all the odd rows and all the even columns keep the same color as that in the first sub-frame of the frame N+2, and other pixels are black; in a second sub-frame period of the frame N+3, pixels at crossings of all the even rows and all the even columns keep the same color as that in the first sub-frame of the frame N+3, and other pixels are black; in a second sub-frame period of the frame N+4, pixels at crossings of all the even rows and all the odd columns keep the same color as that in the first sub-frame of the frame N+4, and other pixels are black.

5. A method for driving a liquid crystal display, comprising:

dividing a frame into a first sub-frame period and a second sub-frame period;

displaying a normal image in the first sub-frame period; and displaying a gray image in the second sub-frame period;

wherein the gray image comprises a plurality of pixels, some of the pixels are black and other pixels are the same as those of the normal image in the first sub-frame period, each of the pixels is black only one time in a predefined minimum period, the minimum period is four frames, and the four frames are frame N+1, frame N+2, frame N+3, and frame N+4, N is a natural number.

6. The method for driving the liquid crystal display as claimed in claim 5, wherein in a second sub-frame period of the frame N+1, pixels at crossings of all the odd rows and all the odd columns are black, and other pixels keep the same color as that in the first sub-frame of the frame N+1; in a second sub-frame period of the frame N+2, pixels at crossings of all the odd rows and all the even columns are black, and other pixels keep the same color as that in the first sub-frame of the frame N+2; in a second sub-frame period of the frame N+3, pixels at crossings of all the even rows and all the even columns are black, and other pixels keep the same color as that in the first sub-frame of the frame N+3; in a second sub-frame period of the frame N+4, pixels at crossings of all the even rows and all the odd columns are black, and other pixels keep the same color as that in the first sub-frame of the frame N+4.

* * * * *